US007267295B2

(12) United States Patent
Mead et al.

(10) Patent No.: US 7,267,295 B2
(45) Date of Patent: Sep. 11, 2007

(54) SHREDDING MACHINES

(75) Inventors: David Mead, Malvern (GB); Paul Arthur Aries, Brierley Hill (GB)

(73) Assignee: ACCO UK Limited, Buckinghamshire (GB)

( * ) Notice: Subject to any disclaimer, the term of this patent is extended or adjusted under 35 U.S.C. 154(b) by 20 days.

(21) Appl. No.: 10/983,518

(22) Filed: Nov. 8, 2004

(65) Prior Publication Data

US 2005/0127216 A1 Jun. 16, 2005

Related U.S. Application Data

(63) Continuation of application No. PCT/GB03/01997, filed on May 9, 2003.

(30) Foreign Application Priority Data

May 9, 2002 (GB) ..... 0210599.7
Jun. 28, 2002 (GB) ..... 0214954.0

(51) Int. Cl.
*B26F 1/14* (2006.01)

(52) U.S. Cl. ..... 241/283; 241/57; 241/60; 241/63; 241/222; 83/691

(58) Field of Classification Search ..... 83/689, 83/691; 241/236, 243, 280, 63, 283
See application file for complete search history.

(56) References Cited

U.S. PATENT DOCUMENTS

| | | | | |
|---|---|---|---|---|
| 3,234,640 A | | 2/1966 | Smeets | |
| 3,234,840 A | * | 2/1966 | Smeets | 83/559 |
| 3,320,843 A | | 5/1967 | Schott, Jr. | |
| 4,043,234 A | * | 8/1977 | Godin et al. | 83/40 |
| 4,997,134 A | * | 3/1991 | MacGregor | 241/3 |
| 5,152,209 A | * | 10/1992 | Berger | 83/670 |
| 5,214,991 A | * | 6/1993 | Shimizu et al. | 83/168 |
| 5,337,639 A | * | 8/1994 | Morrison | 83/111 |
| 5,839,336 A | * | 11/1998 | Yamauchi et al. | 83/167 |
| 6,672,504 B1 | * | 1/2004 | Ueda et al. | 234/50 |

FOREIGN PATENT DOCUMENTS

| | | | |
|---|---|---|---|
| CN | 2438504 Y | | 7/2001 |
| JP | 49-71581 | | 7/1974 |
| JP | 49 071581 | * | 7/1974 |
| JP | 49 071581 A | | 7/1974 |
| JP | 4-61937 | | 2/1992 |
| JP | 04 061937 A | | 2/1992 |

* cited by examiner

*Primary Examiner*—Derris H. Banks
*Assistant Examiner*—Jason Y. Pahng
(74) *Attorney, Agent, or Firm*—Kirschstein, et al.

(57) ABSTRACT

A shredding machine includes a housing which defines a passageway through which a sheet of material to be shredded may pass, a punching mechanism comprising a plurality of punch members, a mechanism to move the punch members from a retracted position in which the punch members are spaced from the passageway to an advanced position in which the punch members extend through the passageway, and a feeding mechanism for feeding the sheet of material through the punching mechanism so that repeated movement of the punch members between the retracted and the advanced positions effects shredding of the material. A method of shredding sheet material comprises feeding a sheet of material to be shredded past a punching mechanism and repeatedly punching the sheet material so as to shred the entire sheet.

12 Claims, 7 Drawing Sheets

SHREDDING MACHINES

CROSS-REFERENCE TO RELATED APPLICATION

This application is a continuation of International Application No. PCT/GB03/01997 (WO 03/095094), filed May 9, 2003, under 35 U.S.C. §365 and 37 C.F.R. §1.53b.

DESCRIPTION OF INVENTION

This invention relates to shredding machines of the kind which are used to shred a sheet of material, typically documentary material, into many small pieces so that the information contained on the material cannot be read. The machines will be described hereinafter in relation to paper, but it will of course be appreciated that many types of sheet material could be so shredded.

A conventional shredding machine comprises a cutting mechanism which comprises two shafts mounted for rotation about respective parallel axes, and cutting discs arranged at spaced intervals on each shaft, the cutting discs intermeshing and the shafts being rotated in opposite directions so as to provide a nip into which documentary material (such as paper) may be fed. The engagement between the circumferential edges of adjacent discs subjects the documentary material to a plurality of longitudinal cuts and the discs may be provided with transverse cutting edges by which the material is subjected to a transverse severing.

These shredding machines produce particles having a certain size. The size of the particle produced determines the security level at which the shredding machine can operate, with smaller particle sizes being necessary for higher security levels. As reconstruction techniques grow more sophisticated there is a continuing demand for shredding machines which can produce smaller particle sizes. Indeed, changes in print technology, such as scaleable fonts and landscape style formats, have led to a requirement for a smaller particle simply to maintain current levels of security. A new standard of security has therefore been proposed, having a maximum particle size of 1 mm by 5 mm.

Typical conventional shredding machines are able to shred material into reasonably small particle sizes, and although the smallest sizes typically achievable are 1 mm by 5 mm these small sizes cannot be reached consistently. It has proved difficult to reach smaller sizes consistently for two main reasons. First, to achieve a good quality of cut using conventional shredding machines of the kind described above it is necessary to precisely intermesh the cutting discs on the two shafts so that the paper can be held taut as it is pierced by the transverse cutting edges. For example, for particle lengths of 4 mm the discs must be aligned to within a tolerance of approximately 2 mm and currently such precision cannot be reliably achieved.

Second, at such small particle sizes the power required to drive the cutting discs increases disproportionately, which means that such shredding machines tend to have a low sheet capacity.

There is, therefore, a need for a shredding machine which can reliably and economically achieve small particle sizes.

According to the first aspect of this invention there is provided a shredding machine comprising: a) a housing which defines a passageway through which a sheet of material to be shredded may pass, and b) a punching mechanism comprising a plurality of punch members, and a mechanism to move the punch members from retracted positions in which the punch members are spaced from the passageway to advanced positions in which the punch members extend through the passageway; and c) a feeding mechanism for feeding the sheet of material through the punching mechanism; so that repeated movement of the punch members between the retracted and the advanced positions can effect shredding of the entire sheet of material.

Since such a shredding machine uses a punching mechanism to shred sheet material different alignment considerations are present than with conventional shredding machines and, in particular, the alignment does not deteriorate as rapidly with use.

Preferably the entire sheet is shredded into particles smaller than 5 mm in diameter. Preferably the particle size is smaller than 3 mm by 5 mm, more preferably the particle size is smaller than 2 mm by 5 mm, and yet more preferably the particle size is smaller than 1 mm by 5 mm. Most preferably the particle size is smaller than 1 mm by 4 mm.

The feeding mechanism may comprise a plurality of in-feed rollers.

Preferably the shredding machine further comprises a die member provided with apertures to receive the punch members in their advanced position.

Conveniently the punch members are moved rectilinearly. Alternatively, however, they may be moved rotationally. Preferably the shredding machine comprises a plurality of rows of punch members. This enables smaller particle sizes to be obtained easily. For example, for rotational shredding machines the punch members may be arranged in rows on a drum. Preferably each row of punch members is staggered with respect to its adjacent row or rows. This enables the paper to be more efficiently shredded.

In one embodiment the shredding machine comprises only two rows of punch members, the diameter of one row of the punch members being from 3 mm to 5 mm and the diameter of the other row of punch members being from 5 mm to 7 mm. Preferably the diameter of the smaller row of punch members is substantially 4 mm and the diameter of the larger row of punch members is substantially 6 mm. It has been found that such an arrangement is convenient for producing small particles and thus meeting the new security standard.

Preferably one row is disposed, in the retracted position of the punch members, on each side of the passageway, and the mechanism to move the punch members is operative to move the punch members in a reciprocating motion. This not only provides the shredding machine with a balanced action, but also enables the punch members themselves to control the movement of the last part of a sheet of paper through the passageway. If desired the reciprocating motion of the punch members may be controlled so that all of the punch members are in their advanced positions substantially simultaneously and all are in their retracted positions substantially simultaneously. In this case, the feeding mechanism may be synchronised with the mechanism for moving the punch members so that the feeding mechanism is activated as the punch members are withdrawn. If desired, the reciprocating motion of the punch members may be controlled such that, in use, one or more rows of punch members will be in engagement with the material to be shredded. This means that the material to be shredded can be supported by the punch members even when the edge of the material has passed the feed rollers. This reciprocating motion may provide the feeding mechanism for feeding the sheet of material through the shredding machine. Alternatively, the punch members may be reciprocated at such a speed that the distance which the sheet of paper falls in the time between the sheet being engaged by successive punch members is within the required size parameters.

The shredding machine may comprise a further feeding mechanism, e.g. an air feeding mechanism as referred to hereafter. The shredding machine may comprise a support on which the paper to be shredded may be located. Conveniently the support comprises a plurality of fingers which extend between the punch members of at least one row of punch members. This provides a convenient way of locating the paper to be punched.

The shredding machine may further comprise an adjustment mechanism for changing the particle size. The particle size may be changed from particles having a width equivalent to the diameter of the punch member to much smaller particles. The minimum particle width could be very small, for example 0.1 mm. Preferably the feeding mechanism provides the adjustment mechanism.

According to this invention there is also provided a method of shredding sheet material comprising feeding a sheet of material to be shredded past a punching mechanism and repeatedly punching the sheet material so as to shred the entire sheet. Preferably the sheet material is shredded into particles of a size less than 5 mm in diameter, more preferably the sheet material is shredded into particles of less than 5 mm by 3 mm, more preferably less than 5 mm by 2 mm, more preferably less than 5 mm 1 mm, and most preferably less than 4 mm by 1 mm. Preferably the punching mechanism is provided by an array of punch members which conveniently are moved rectilinearly and the punch members are preferably moved reciprocably. Alternatively the punch members may be rotated.

The method preferably further comprises the use of in-feed rollers. Preferably the in-feed rollers control the rate of movement of the material.

Preferably the feeding is intermittent.

The method may further comprise supporting the material to be shredded.

Preferably the method further comprises shredding the sheet material length-wise from one edge, the material being moved past the punch members between two punch movements by an amount smaller than the diameter of the punch members. This generates small particles.

In addition to the above a second aspect of this invention relates to improvements in feeding mechanisms for sheet materials, such as paper, which are fed into a device, such as a shredder, for processing therein. These mechanisms are described hereinafter in relation to paper, but it will of course be appreciated that they could be used with many different types of sheet material.

One problem that can arises in shedding machines is that when the edge of the paper leaves the rollers there is a small amount of paper left above the shredding mechanism which is not fed through. This problem can be minimized by siting the feed rollers as close as possible to the shredding mechanism, and by using gravity to assist the feed of the last part of the paper, but these solutions are not wholly satisfactory.

There is, therefore, a need for a continuous feed mechanism which can feed an entire piece of paper through such mechanisms.

According to a second aspect of this invention there is provided a shredder for sheet material comprising a shredding mechanism and an air feeding mechanism.

Use of an air feeding mechanism enables the sheet material to be fed completely through the shredding mechanism. The mechanism also has advantages in that the sheet material tends to stretch or crinkle less than when using a conventional mechanism. The air feeding mechanism also draws dust generated by the shredding process through the shredder where it is less likely to present a health hazard.

Preferably the air feeding mechanism comprises a suction mechanism which conveniently comprises a suction pump. The pressure difference generated by the suction mechanism may be greater than 0.5 bar.

Conveniently an air flow path extends through the shredding mechanism, the suction means being preferably disposed after the shredding mechanism in the air flow path.

Preferably the air feeding mechanism comprises a collection facility for collecting shredded particles, which conveniently comprises a permeable bag. Conveniently the collection facility, or a further collection facility, is also suitable for collecting dust generated during the shredding process.

Preferably the air feeding mechanism comprises a plurality of intermediate chambers disposed in the air flow path after the shredding mechanism and before the collection facility.

Preferably the shredder further comprises feed rollers, which are conveniently located in the air flow path before the shredding mechanism. These assist the initial feeding of the sheet material.

A preferred embodiment of this invention will now be described, by way of example only, with reference to the accompanying drawings, in which.

Figure 5:
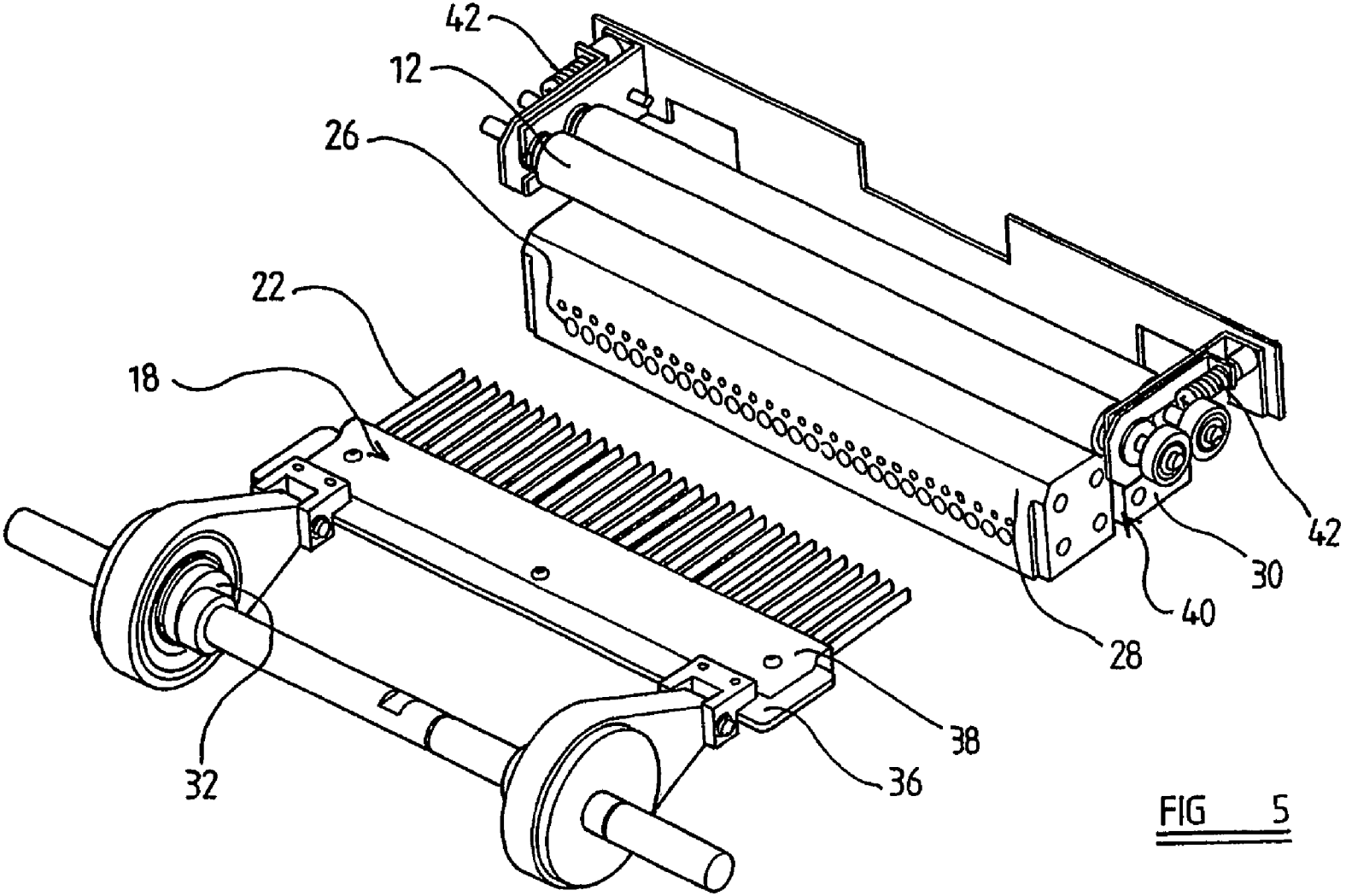
FIG. 5 shows schematically an exploded perspective view of the punch assembly of FIG. 1.

The shredding machine 10 comprises a pair of in-feed rollers 12, a punch assembly 14, and a drive/transmission mechanism 16. The punch assembly 14 is shown in more detail in FIGS. 2 and 5. It comprises two punch plates 18, 20 each of which carries a row of punch members 22, 24, and two die blocks 28, 30.

Figure 2:
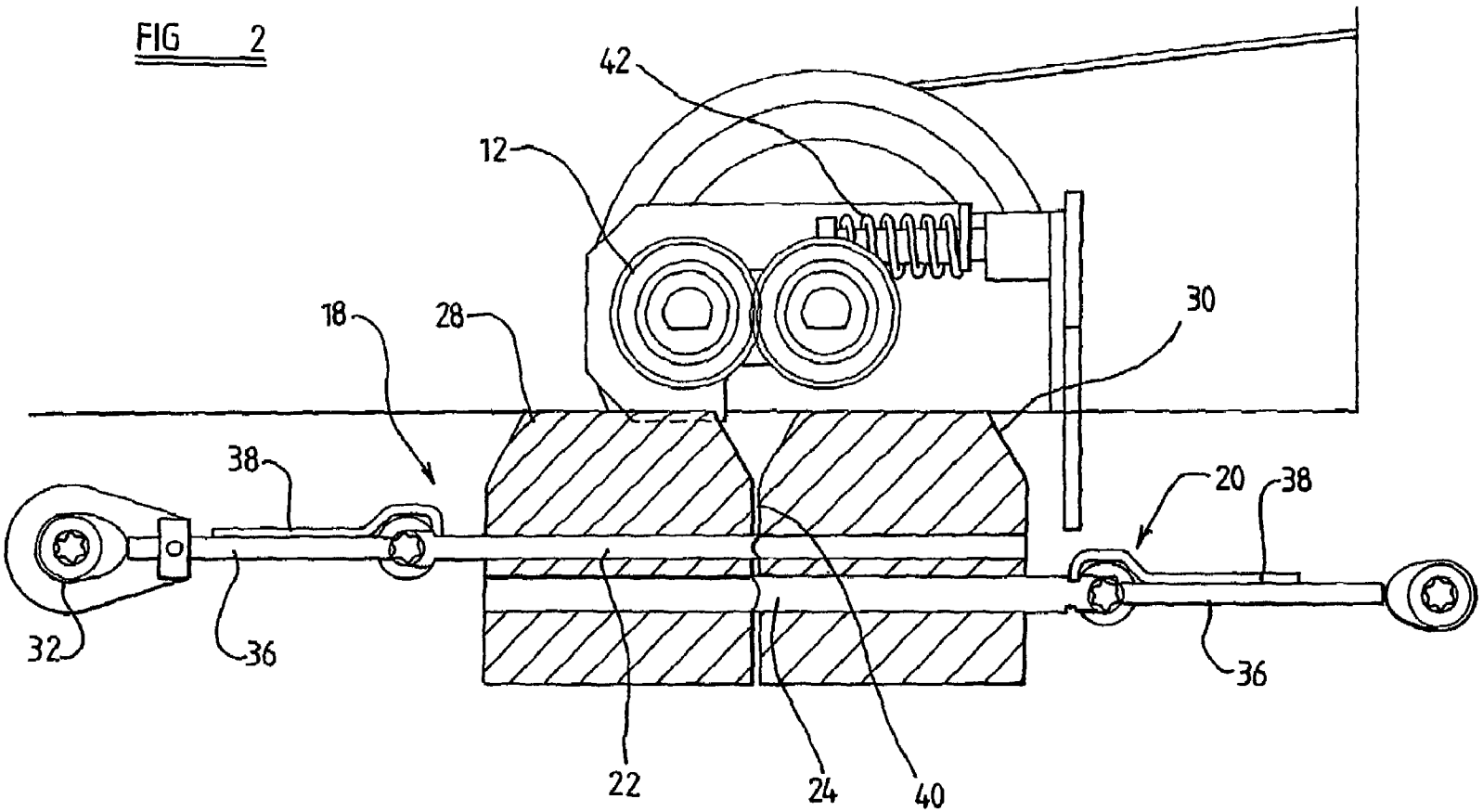
FIG. 2 is a side section showing details of the punching mechanism.
Figure 4A:
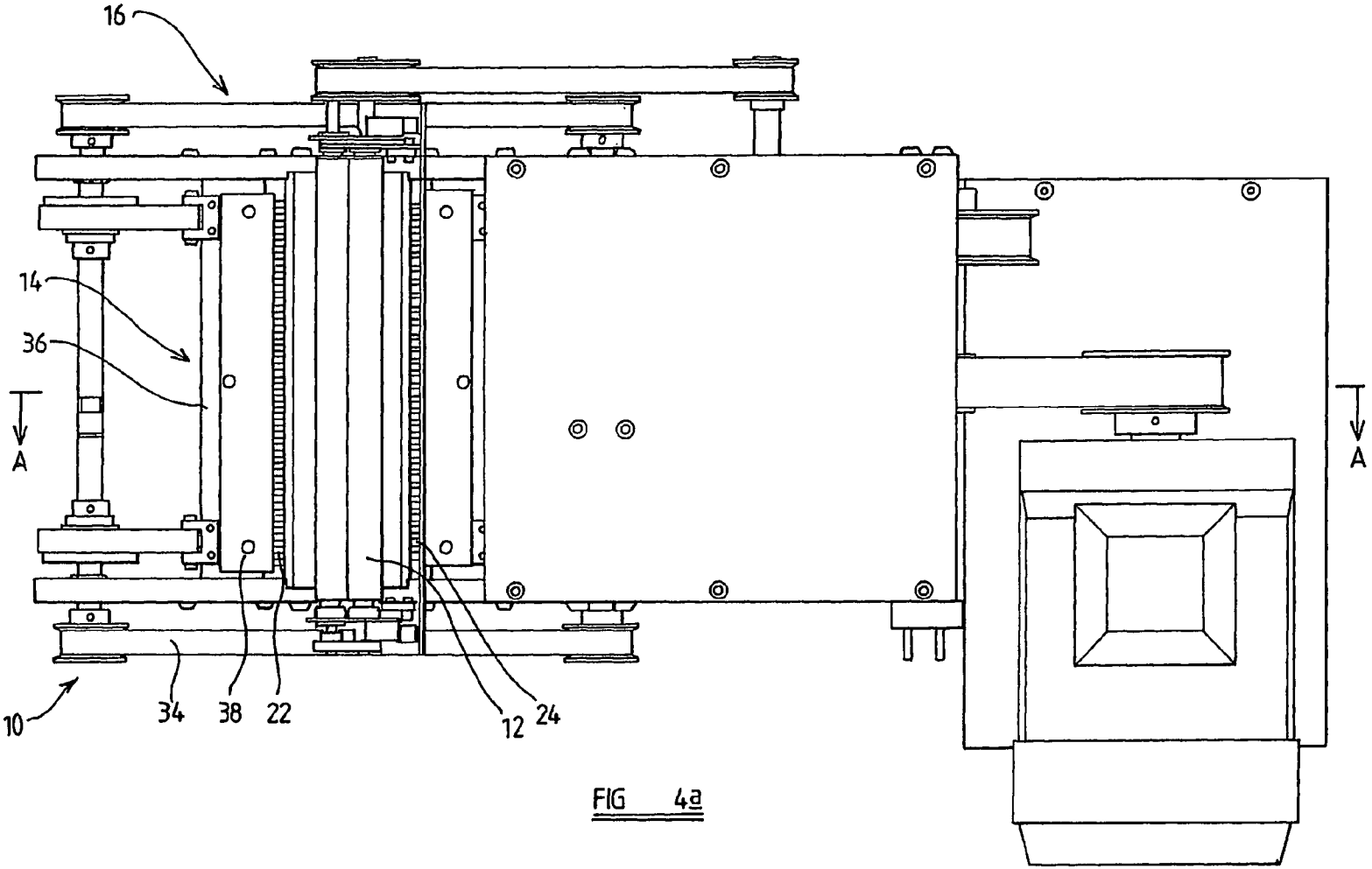
FIG. 4A is a top view of the shredding machine showing details of the drive mechanism.
Figure 4B:
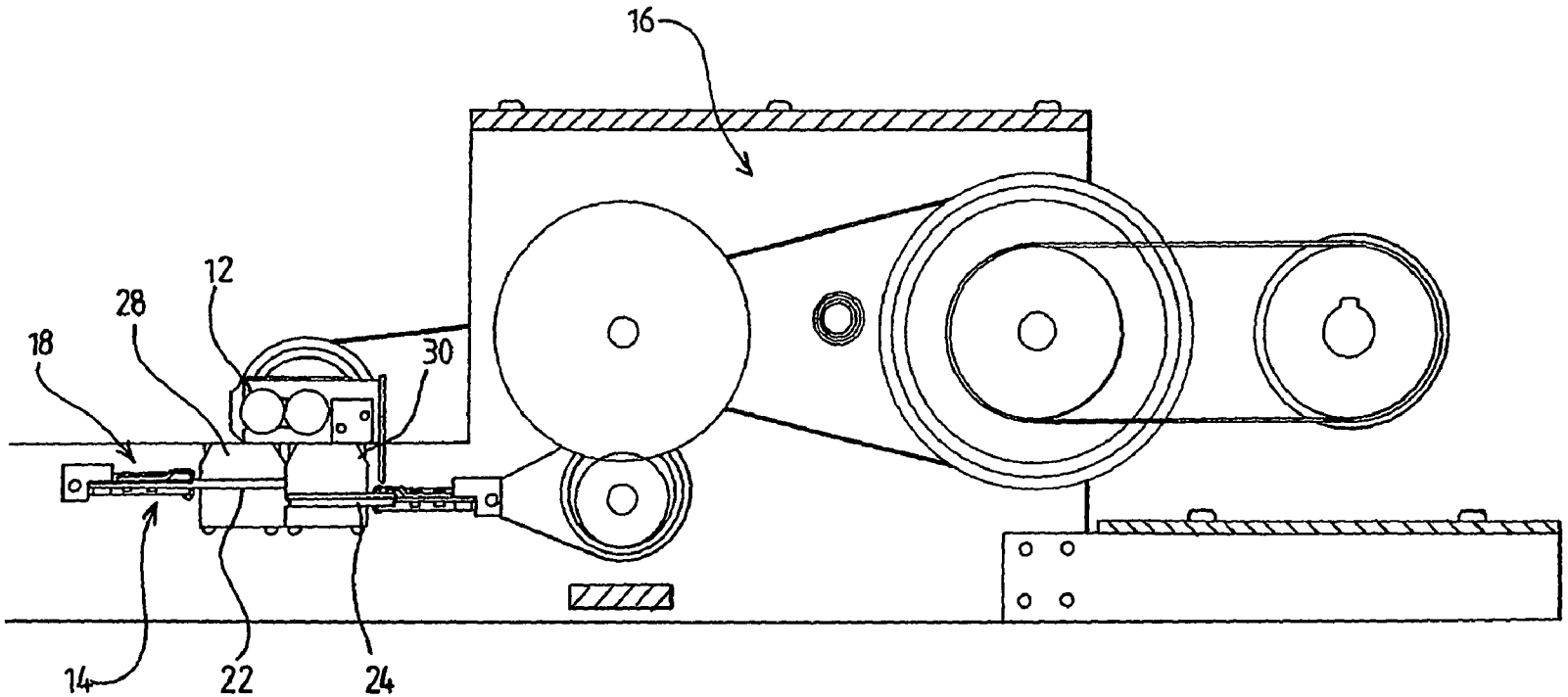
FIG. 4B is a section on the line A-A through FIG. 4A.

The mechanism by which the punch plates 18, 20 are moved is best seen in FIG. 2. A toothed belt 34, driven by a motor by way of a number of belts and/or gear wheels (FIG. 4), drives an eccentric cam 32 which moves a push plate 36 to advance the punch plates 18, 20 into the shredder. The push plate 36 is attached to a finger plate 38 which pulls the punch plate 18, 20 away from the shredder as the cam revolves. Such mechanisms are common in conventional automatic punching devices and will not be -described further herein.

The two die blocks 28, 30 have two rows of bores 26 which correspond to the rows of punch members 22, 24. The bores 26 maintain the alignment of the punch members 22, 24 and act as die apertures through which the punch members 22, 24 may extend.

Figure 3:
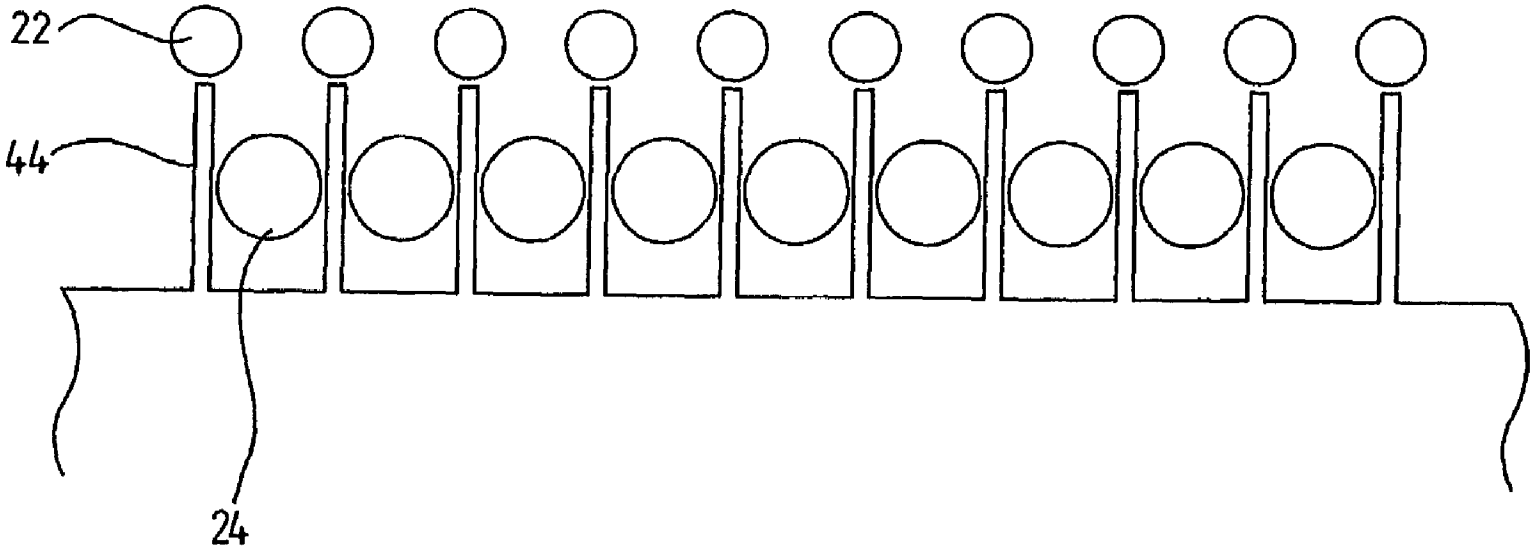
FIG. 3 is a front section through the punching mechanism showing details of the support means.

The die blocks are horizontally aligned and arranged spaced from each other by a small gap 40 which defines a passageway through which paper to be shredded may pass. One row of punch members 22, 24 is mounted on each side of this passageway 40, the smaller row 22 being disposed above the larger row 24. The rows of punch members are staggered as shown for example by the aperture plate 26 in FIG. 5 so that the centre of each smaller punch member lies between the centers of two larger punch members. The larger row of punch members 24 are spaced apart from each other by a distance less than the diameter of the smaller row of punch members 24, as shown in FIG. 3.

Each of the rows of punch members 24, 26 has a retracted position (shown in FIG. 1) in which the punch members 24, 26 are spaced from the passageway 40 and an advanced position in which the punch members extend through the passageway 40. The alignment of the punch members is maintained throughout their travel by the bores 26 in the die blocks 28, 30.

The in-feed rollers 12 comprise two horizontally spaced, rubber coated cylinders, which are mounted for rotation about respective parallel axes, and between which paper to be shredded may be fed. One of the cylinders is attached to its mount via a spring 42. This enables multiple sheets of paper to be fed through the rollers 12 whilst tension is maintained on the paper.

The punching mechanism 14 is driven continuously by a motor via a belt and gear system 16. The in-feed rollers 12 are driven by way of a belt (FIG. 4A) from a separate, stepper, motor (not shown). The stepper motor is synchronised with the action of the punch mechanism 14. As the punch mechanism 14 is withdrawn, the stepper motor is activated, and feeds paper through the passageway 40. Thus the drive to the in-feed rollers 12 is intermittent, only being activated as the punch mechanism is withdrawn. The in-feed rollers are started as the punch members 22, 24 are withdrawn from the small gap 40, and the in-feed rollers are stopped as the punch members are moved into engagement, i.e. as the punch members re-enter the passageway 40.

The paper is supported by the in-feed rollers 12 whilst being shredded. A further support is shown in FIG. 3. This comprises a row of fingers 44 which extend between the lower row of punch members 24 to nearly abut the upper row of punch members 22, there being a clearance of only approximately 0.2 mm between the punch members 22 and the fingers 44.

The punch shredder 10 may be operated as follows. The user positions the edge of the paper between the in-feed rollers 12, and turns on the shredder 10. Paper is thus drawn through the in-feed rollers 12 with the tension on the paper being maintained by spring 42.

The in-feed rollers 12 feed the paper into the passageway 40 between the die blocks 28, 30 and the paper is propelled downwards until it meets the punch mechanism 14. The drive to the punch mechanism 14 is controlled so that the two rows of punch members 22, 24 are driven in a reciprocating motion so that both are in the advanced position substantially simultaneously, and both are in the retracted position substantially simultaneously. This produces a balanced shredding action.

As the leading edge of the paper approaches the first row of punch members 22, the punch members 22 will remove a circle up to 4 mm in diameter from the paper, depending upon the feed rate of the paper. In practice, the feed rate is controlled so that only a small proportion of the circle is punched by each forward motion of punch members 22. As the paper continues to be fed through it is punched by punch members 24. These may remove a circle up to 6 mm in diameter. More usually, however, the feed rate is controlled so that the paper is shredded into extremely small crescent shapes. The size of the shapes is determined by the feed rate of the feed rollers 12. If desired the width of the particle may be reduced to sizes as small as 0.1 mm.

When the trailing edge of the paper leaves the in-feed rollers 12 the paper falls until it rests on the support means, the fingers 44. The upper row of punch members 22 then punches out a row of 4 mm holes in the paper. The paper between the punch members 22 and the fingers 24 is also removed, usually being sheared off at the die aperture, since the clearance between the punch members 22 and the fingers 44 is so small. The paper then falls until the top of the punched out hole rests upon the fingers 44 and the lower row of punch members 24 is operated, shredding the paper further. This process is then repeated until the entire sheet of paper has been shredded.

To ensure positive feeding of the paper into the passageway in the shredding operation, preferably the in-feed rollers extend as close to the punching zone as possible. However, in the event that a trailing edge of paper, after leaving the in-feed rollers, fails to pass through the punching zone, it has been found that entry of the next batch of paper between the in-feed rollers in a further punching operation will clear any residual paper from the previous batch remaining in the passageway.

Figure 6:
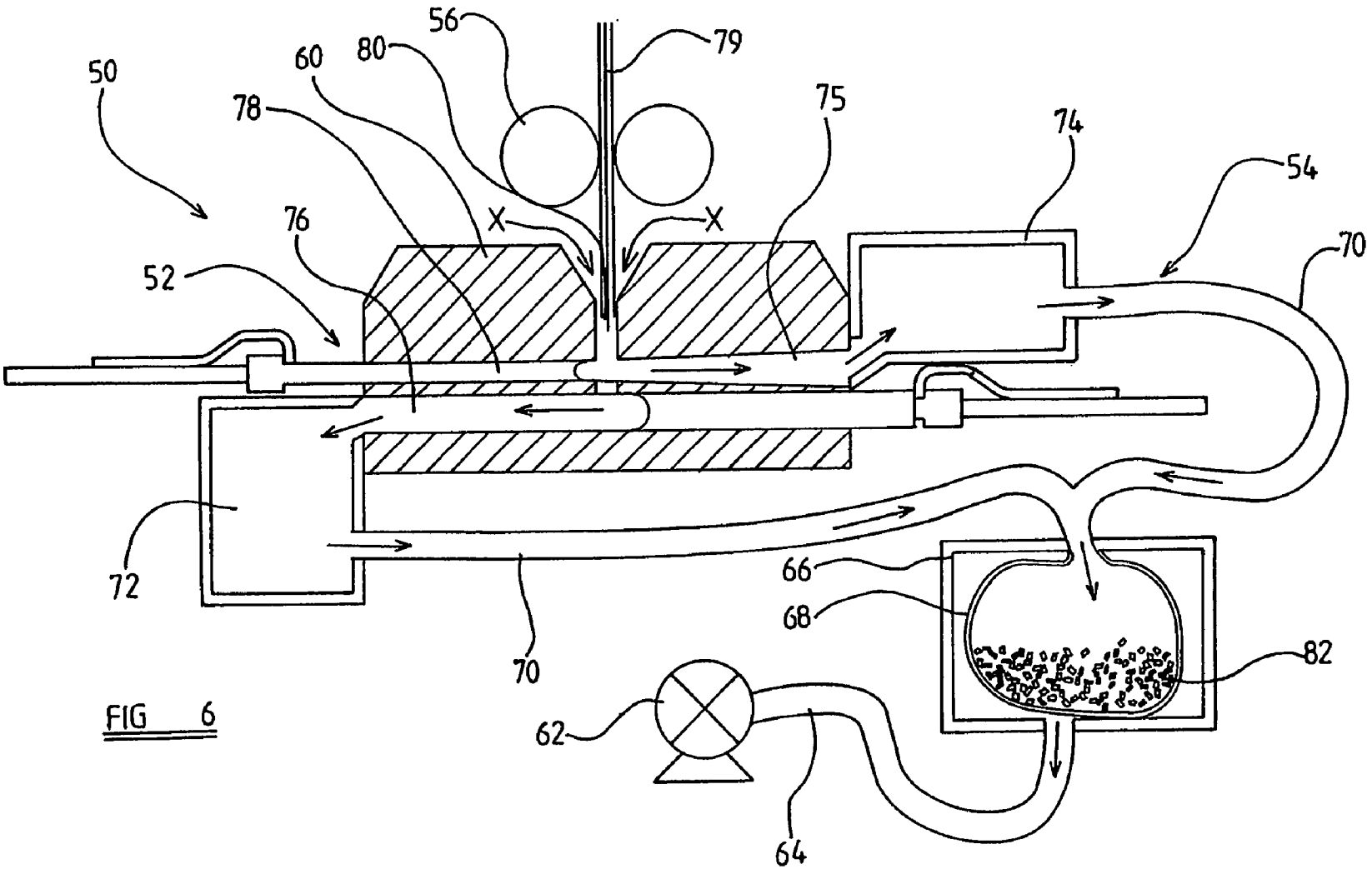
FIG. 6 shows schematically an alternative embodiment having an additional air feeding mechanism.

Referring now to FIG. 6 of the drawings, this shows a shredding machine 50 which comprises a shredding mechanism 52, in-feed rollers 56, and additionally an air feeding mechanism 54. In this embodiment the shredding mechanism comprises a plurality of punch members 58 positioned in die members 60.

The air feeding mechanism 54 comprises a suction pump 62 which is connected by tubes 64 to a collection chamber 66 which contains a paper bag 68 which functions as a collecting bag for shredded particles. Tubes 70 connect the collection chamber to two smaller chambers or manifolds 72, 74. Each manifold 72, 74 is arranged at the outlets of aperture channels 76, 78, which receive punch members 58 when in their advanced position.

Figure 1:
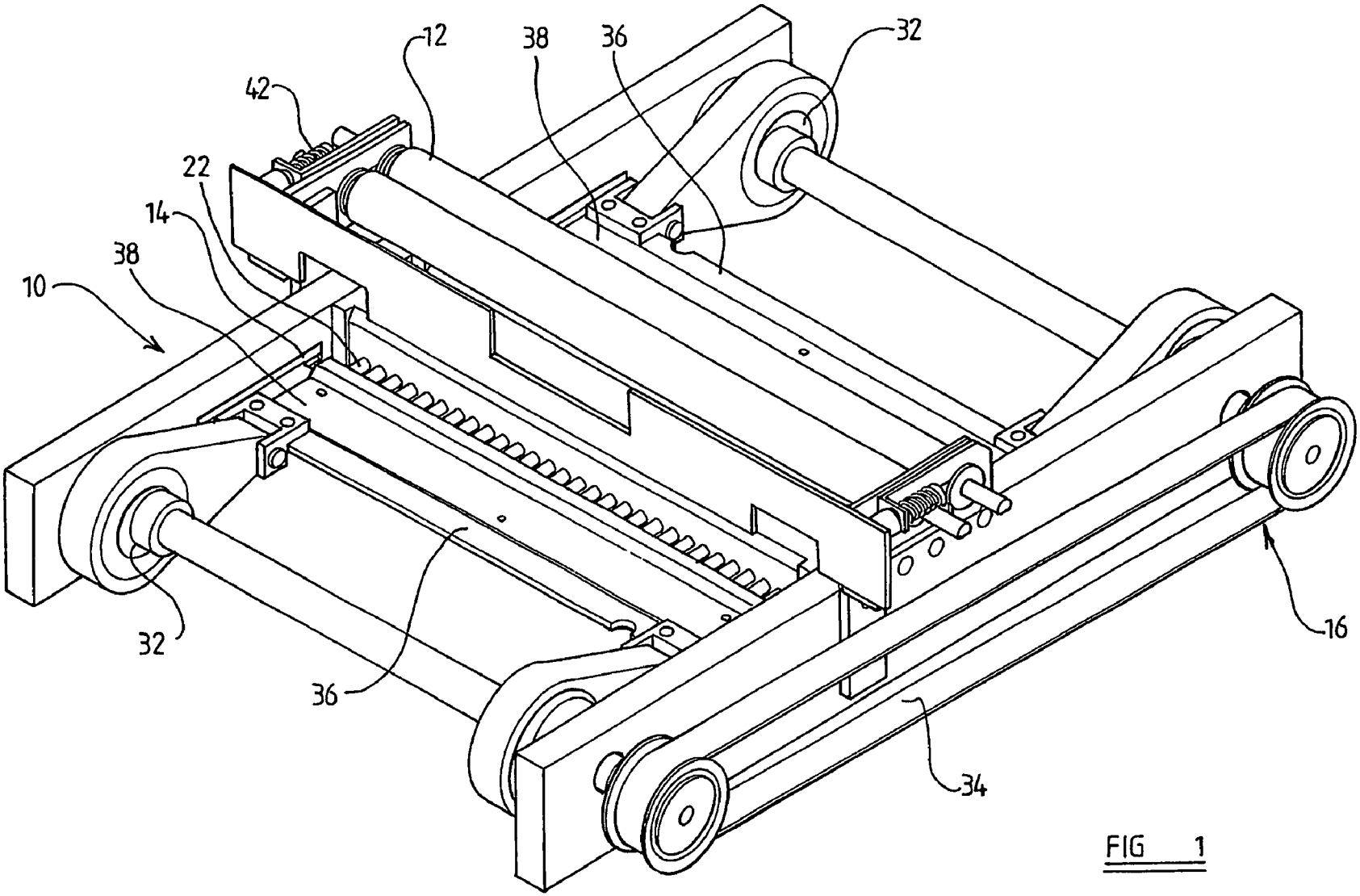
FIG. 1 is a perspective view showing the shredding machine which is the preferred embodiment of this invention.

The air flow path through the machine will now be described. Air is drawn as shown by arrows X through a feed channel 80 in the die apertures 60, which also comprises an inlet for paper being fed to the shredding mechanism. From the feed channel 80, when the punch members are in their retracted position, as shown in FIG. 1, air flows through the aperture channels 76, 78 to the manifolds 72, 74. These manifolds 72, 74 provide a convenient way of connecting the many aperture channels 76, 78 in the die members 60. Air flows from the manifolds 72, 74 to the paper bag 68 in the collection chamber 66, and through the paper bag 68 to the pump 62.

When the punch members 58 are in their advanced position they extend past the feed channel 80 into the aperture channels 76, 78 and substantially prevent air flow through the air feeding mechanism 54.

To operate the shredder 50 a plurality of paper sheets 79 are fed into the shredding mechanism through in-feed rollers 56. These rollers 56 provide the initial feed, transporting the edge of the paper to the feed channel 80. Once in the feed channel 80 the paper is subjected to a degree of suction pressure, and the high velocity of air in the in-feed channel 80 draws the paper along the air path. The velocity of the air increases as the number of sheets of paper increases since this makes the in-feed channel 80 narrower and thus the effectiveness of the air feeding mechanism 80 is retained despite the larger load.

When the paper reaches the shredding mechanism 54 it is shredded, generally as described above. A plurality of small paper particles 82 are thereby generated, which are carried along the air flow path through the aperture channels 76, 78, the manifolds 72, 74 and the tubes 70 to the collection chamber 66. These then collect in the paper bag 68. Once full the paper bag 68 may be easily emptied, and the shredded particles 82 disposed of.

The suction generated by the air feeding mechanism 54 draws the paper through the shredder 50 and acts as a convenient way of collecting shredded particles 82. The air feeding mechanism can, as shown in the embodiment above, be supplemented by in-feed rollers, but can also function as the sole feeding mechanism. Unlike in-feed rollers it does not tend to crinkle or stretch the paper, but provides a smooth and effective feed.

Although described above in relation to a shredder it will be apparent that the air feeding mechanism outlined herein could be used in other devices, for example a printer, where sheet material must be fed past a processing head.

It will, of course, be appreciated that such a shredding machine could be used for many types of documentary material as well as paper. The size of the particles produced can be varied easily by changing the in-feed rate of the shredder, or the size or arrangement of the punch members. Furthermore, compared to conventional shredders, the machine can accept a relatively large number of sheets of paper without excessive power consumption.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realizing the invention in diverse forms thereof.

The invention claimed is:

1. A shredding machine comprising:

a) a housing which defines a passageway through which a sheet of material to be shredded passes;

b) a punching mechanism including a plurality of elongate punch members each having a longitudinal axis, the elongate punch members being aligned so that their longitudinal axes are parallel to each other, and a mechanism for moving the elongate punch members from retracted positions in which the elongate punch members are spaced from the passageway to advanced positions in which the elongate punch members extend through the passageway;

c) a feeding mechanism for feeding the sheet of material through the punching mechanism; and d) a drive mechanism to drive the mechanism for moving the elongate punch members, to repeatedly move each elongate punch member rectilinearly between the retracted and advanced positions such that as the sheet of material passes through the shredding machine, it is repeatedly punched by the elongate punch members effecting shredding of the entire sheet of material into particles so that information contained on the sheet of material cannot be reads, wherein the elongate punch members are arranged in a plurality of rows which are arranged in at least one pair, one row of the at least one pair being disposed, in the retracted positions of the elongate punch members, on each side of the passageway, and in which the mechanism for moving the elongate punch members is operative to move the at least one pair of the elongate punch members in a reciprocating motion.

2. The shredding machine according to claim 1, in which the entire sheet of material is shredded into particles smaller than 5 mm in diameter in size.

3. The shredding machine according to claim 2, in which the particle size is smaller than 1 mm by 4 mm.

4. The shredding machine according to claim 1, in which the feeding mechanism includes a plurality of in-feed rollers.

5. The shredding machine according to claim 1, further comprising a die member provided with apertures to receive the elongate punch members in their advanced positions.

6. The shredding machine according to claim 1, in which each row of elongate punch members is staggered with respect to at least one adjacent row.

7. The shredding machine according to claim 1, comprising only two rows of the elongate punch members, one of the rows of the elongate punch members having a diameter between 3 mm and 5 mm, and the other of the rows of the elongate punch members having a diameter between 5 mm and 7 mm.

8. The shredding machine according to claim 7, in which the diameter of the one row of the elongate punch members is substantially 4 mm, and the diameter of the other row of the elongate punch members is substantially 6 mm.

9. The shredding machine according to claim 1, in which the reciprocating motion is controlled so that all of the elongate punch members of the at least one pair are in their advanced positions substantially simultaneously and all of the elongate punch members of the at least one pair are in their retracted positions substantially simultaneously.

10. The shredding machine according to claim 9, in which the feeding mechanism is synchronized with the mechanism for moving the elongate punch members so that the feeding mechanism is activated as the mechanism for moving the elongate punch members of the at least one pair withdraws the elongate punch members of the at least one pair.

11. The shredding machine according to claim 1, further comprising a support on which the sheet of material to be shredded is located.

12. The shredding machine according to claim 11, in which the support includes a plurality of fingers which extend between the elongate punch members of at least one row of the elongate punch members.

* * * * *